US008157356B2

(12) United States Patent
Yamamoto et al.

(10) Patent No.: US 8,157,356 B2
(45) Date of Patent: Apr. 17, 2012

(54) INK JET PRINTING HEAD

(75) Inventors: Akira Yamamoto, Yokohama (JP); Katsuhiko Takano, Yokohama (JP); Junji Yasuda, Kawasaki (JP); Manabu Sueoka, Yokohama (JP); Toshiaki Hirosawa, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 356 days.

(21) Appl. No.: 12/499,490

(22) Filed: Jul. 8, 2009

(65) Prior Publication Data

US 2010/0013889 A1 Jan. 21, 2010

(30) Foreign Application Priority Data

Jul. 18, 2008 (JP) ..... 2008-187110

(51) Int. Cl.
*B41J 2/335* (2006.01)

(52) U.S. Cl. ..... 347/56

(58) Field of Classification Search ..... 347/84, 347/85, 87, 20, 54, 56
See application file for complete search history.

(56) References Cited

U.S. PATENT DOCUMENTS 6,137,506 A 10/2000 Sueoka
6,257,703 B1 7/2001 Hirosawa et al.
6,471,901 B1 10/2002 Kawamura et al.
7,533,960 B2 5/2009 Yasuda et al.
7,690,767 B2 4/2010 Hirosawa et al.
7,775,638 B2 8/2010 Hirosawa et al.
2009/0141062 A1 6/2009 Takano et al.
2009/0141063 A1 6/2009 Takano et al.
2009/0179965 A1 7/2009 Hirosawa et al.

FOREIGN PATENT DOCUMENTS

JP 2007-160834 6/2007

OTHER PUBLICATIONS

Machine-generated translation of JP 2007-160834, published on Jun. 2007.*

* cited by examiner

*Primary Examiner* — Huan Tran
(74) *Attorney, Agent, or Firm* — Fitzpatrick, Cella, Harper & Scinto

(57) ABSTRACT

There is inexpensively and simply provided a highly reliable printing head including a printing element substrate which is located with high positioning precision and therefore causes no occurrence of ink leak regardless of the printing head having a large printing width. An ink jet printing head comprises a plurality of printing element substrates, in each of which a plurality of ejecting openings, printing elements and an ink supply opening are provided, a support member and an ink supply member. The support member is formed of a first member and a second member that is integral with the first member so as to surround the first member, and the support member and the ink supply member are bonded in such a manner that bonding faces of the first member and the second member, and the second member are not in contact with the opening.

6 Claims, 11 Drawing Sheets

INK JET PRINTING HEAD

BACKGROUND OF THE INVENTION

1. Field of the Invention

The present invention relates to an ink jet printing head, and particularly, to a printing head in an ink jet printing apparatus for performing a printing operation by ejecting a print liquid such as ink onto a print medium.

2. Description of the Related Art

An ink jet printing apparatus is a printing apparatus of a so-called non-impact printing system and generates almost no noise at printing. The ink jet printing apparatus can perform printing at a high speed and onto various types of print mediums. Therefore, the ink jet printing apparatus has been widely adopted as an apparatus performing printing, such as a printer, a word processor, a facsimile machine or a copier.

As a representative ink ejecting system in the ink jet printing apparatus, there is a system using an electrothermal conversion element as a printing element. In the ink jet printing apparatus using this electrothermal conversion element, the electrothermal conversion element is provided in a print liquid chamber and an electrical pulse as a printing signal is applied to the electrothermal conversion element, thereby providing thermal energy to ink. Air bubble pressures at foaming (at boiling) of the ink generated due to a phase change of the ink at this point are used for ejecting of ink liquid droplets.

When a printing head having a large printing width is used, it is possible to perform printing at a high speed. For example, there is known a printing head in which printing element substrates each having a printing width of one inch+α are arranged in a staggered shape in such a manner as to form an overlap region (L) with each other, providing a printing width of four inches as a whole (For example, Japanese Patent Laid-Open No. 2007-160834).

FIG. 10 is a perspective view showing the conventional printing head. A plurality of printing element substrates H1100 are supported and fixed on a large-scaled support member H1200. The printing element substrates H1100 are arranged in a staggered shape in such a manner as to form an overlap region (L) with each other.

In recent years, a higher speed of printing has been demanded, and there is known also a printing head having a printing width of four inches to 12 inches.

In the printing head in which the plurality of the printing element plates are arranged in a staggered shape, particularly in a case of performing the printing at high resolution and at a high grade as in the case of a photograph image, the plurality of the printing element substrates are required to be arranged with high precision by an interval of approximately several μm from each other. In the conventional support member for supporting the printing element substrates, it is made of a sintered element of alumina. This alumina-sintered element generally causes a dimension error of approximately ±1%. Therefore, in a case where in an elongated support member having a length equal to or more than four inches, for example, 12 inches, ink supply openings are sintered and formed, the position dimension precision of the ink supply opening has the technical problem consequently.

FIG. 11 is a diagram explaining a state where the ink supply opening H1101 in the printing element substrate H1100 shown in FIG. 10 and an ink introduction opening H1201 in the support member H1200 are shifted in position from each other. This figure shows a schematic cross section taken along line XI-XI in FIG. 10. The printing element substrates are arranged with position precision of several μm from each other on the support member H1200, but in a case of a printing head having a printing width of four inches, a distance M made by the remotest positions of the ink introduction openings H1201 of the support member H1200 produces a variation of approximately ±1 mm. In consequence, the ink supply opening H1101 in the printing element substrate H1100 and the ink introduction opening H1201 in the support member H1200 are shifted in position from each other. Therefore, the bonding area between the printing element substrate H1100 and the support member H1200 can not be sufficiently secured and the ink may be leaked therebetween. Further, the bonding area may not be secured at all.

For forming the ink introduction opening H1201 at an accurate position for the purpose of overcoming the above problem, there is also a method of forming the ink introduction opening by machining after alumina sintering. In the method of forming the ink introduction opening by machining after the alumina sintering, however, it leads to a large increase in cost of the printing head.

SUMMARY OF THE INVENTION

The present invention is made in view of the foregoing problems, and an object of the present invention is to inexpensively and simply provide a printing head with high reliability including a printing element substrate which is located in a high positioning precision and therefore causes no occurrence of ink leak regardless of the printing head having a large printing width.

For achieving the above object, an ink jet printing apparatus of the present invention comprises a plurality of printing element substrates in which a plurality of ejecting openings for ejecting ink, printing elements for generating ejecting energy ejecting the ink, and an ink supply opening for supplying the ink to the ejecting openings are formed, a support member which supports the printing element substrate and includes a plurality of ink introduction openings for supplying the ink to the ink supply openings, and an ink supply member which is bonded to the support member and includes an ink storage chamber for storing the ink, wherein the support member is formed of a first member in which the ink introduction opening is formed and a second member which is made of a material different from that of the first member and is integral with the first member so as to surround the first member, and the support member and the ink supply member are bonded in such a manner that bonding faces of the first member and the second member, and the second member are not in contact with the ink storage chamber.

According to the above arrangement, the bonding faces of the first member and the second member are bonded so as not to contact the ink storage chamber in the ink supply member, and the frame member does not get in contact with the ink. Therefore, there can be inexpensively and simply provided a highly reliable printing head including a printing element substrate which is located with high positioning precision and therefore causes no occurrence of ink leak regardless of the printing head having a large printing width.

Further features of the present invention will become apparent from the following description of exemplary embodiments (with reference to the attached drawings).

DESCRIPTION OF THE EMBODIMENTS

Hereinafter, embodiments of the present invention will be in detail explained with reference to the drawings.

(First Embodiment)

Figure 1:
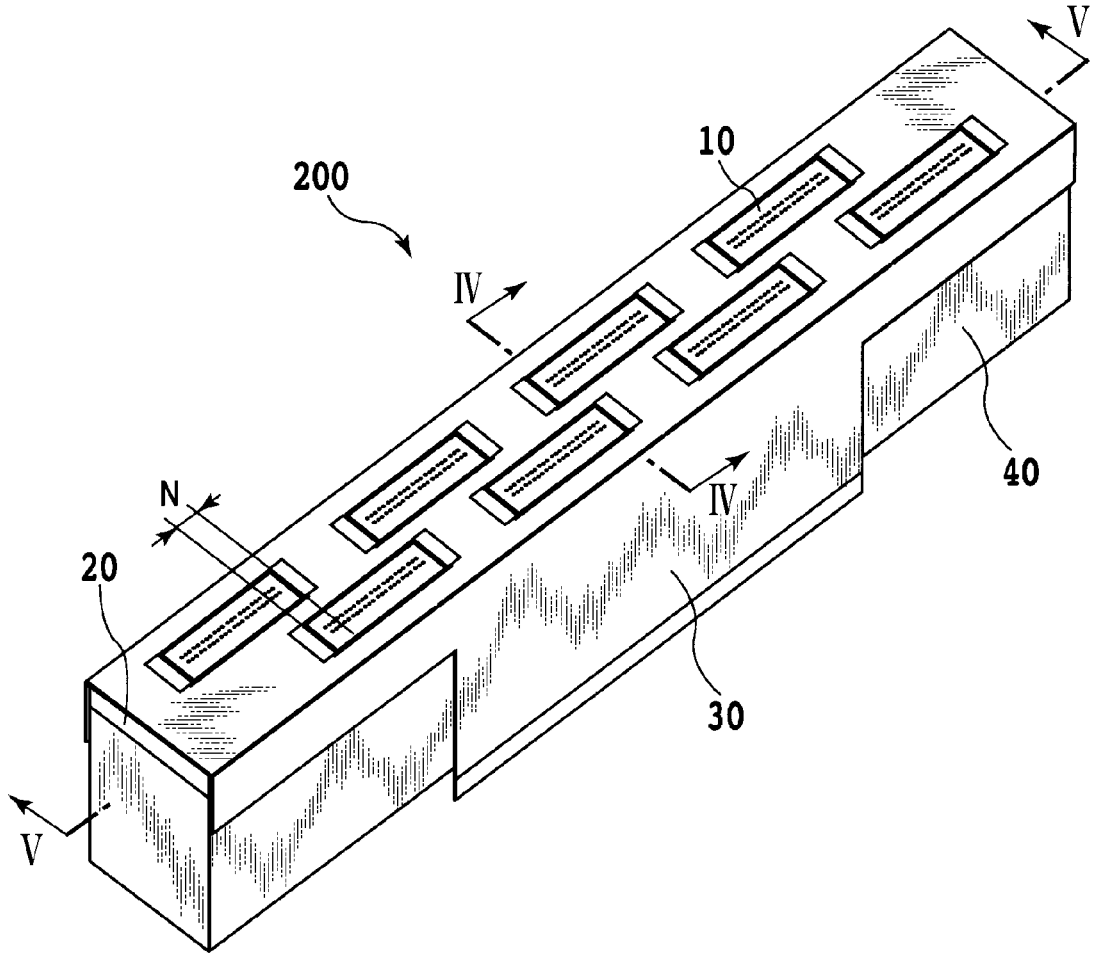
FIG. 1 is a perspective view showing a printing head according to a first embodiment of the present invention.
Figure 2:
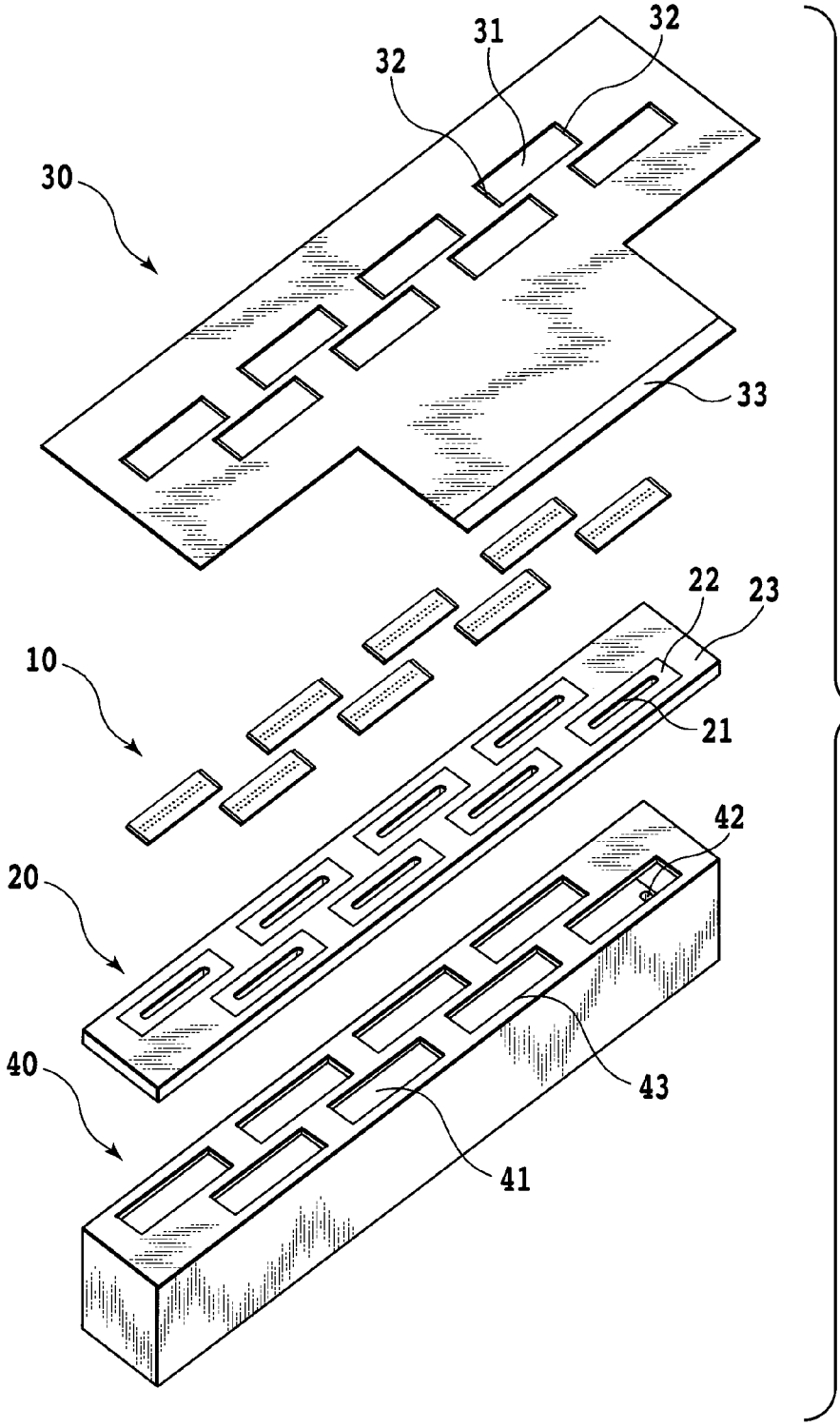
FIG. 2 is an exploded perspective view showing the printing head according to the first embodiment of the present invention.

FIG. 1 is a perspective view showing a printing head according to the present embodiment. FIG. 2 is an exploded perspective view showing the printing head according to the present embodiment.

A printing head 200 in the present embodiment comprises a support member 20 in which a plurality of printing element substrates 10 are arranged, an electrical wiring member 30 and an ink supply member 40.

The support member 20 is a member for supporting, fixing and holding the printing element substrates 10. The support member 20 is formed of printing element substrate mounting members 22 and a frame member 23 molded integrally with the mounting members 22. The printing element substrate mounting member 22 is made of, for example, alumina ($Al_2O_3$).

A bonding face of the ink supply member 40 with the support member 20 is provided with openings 43 formed at positions corresponding to the printing element substrate mounting members 22 of the support member 20, the opening 43 being sized to be smaller than an outer dimension of the printing element substrate mounting member 22.

The ink supply member 40 and the support member 20 are bonded and fixed with each other. This bonding means is not limited to bonding by an adhesive, and may include bonding means such as heat adhesion, supersonic adhesion or laser adhesion or may include a bonding method of pressing a seal rubber or a flexible film.

The electrical wiring substrate 30 includes openings 31 for incorporating the printing element substrates 10 therein, electrical terminals 32 corresponding to electrodes 14 of the printing element substrate 10, and an external signal input terminal 33 for receiving an electrical signal from a printing apparatus body.

The ink supply member 40 is a component for supplying ink from an ink tank (not shown) to the printing element substrates 10, for example, and is formed by injection molding using a resin material. An ink storage chamber 41 is formed in the ink supply member 40 for supplying ink to the printing element substrates 10. The ink is introduced from an opening 42 to the ink storage chamber 41 through an ink supply tube (not shown) from the ink tank. A filter member (not shown) is provided between the ink supply tube and the opening 42 for removing foreign matters mixed in the ink.

Figure 3A:
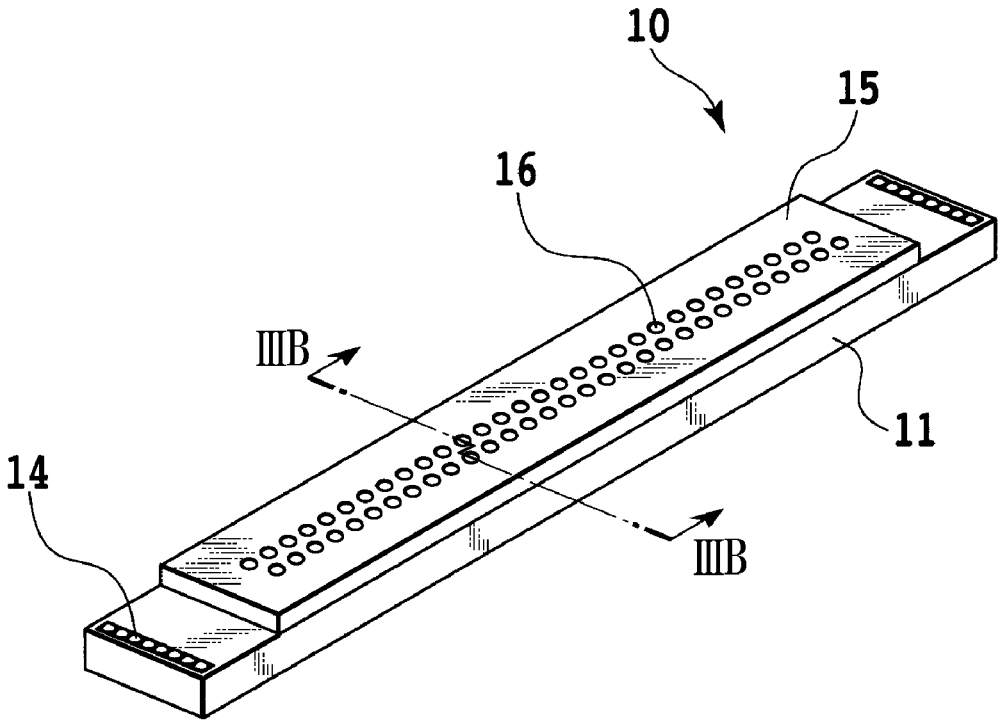
FIGS. 3A and 3B are explanatory diagrams each explaining an arrangement of a printing element substrate according to the first embodiment of the present invention.
Figure 3B:
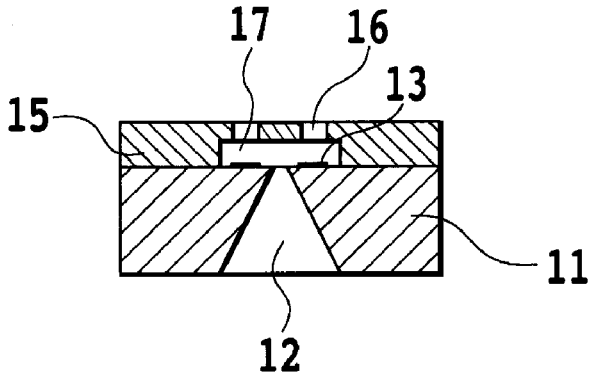

FIGS. 3A and 3B are explanatory diagrams each explaining an arrangement of the printing element substrate 10 according to the present embodiment. FIG. 3A is a perspective view showing the printing element substrate 10, and FIG. 3B is a cross section showing an outline in line IIIB-IIIB cross section in FIG. 3A.

The printing element substrate 10 is a device for ejecting ink. In the printing element substrate 10, an elongated groove-shaped ink supply opening 12 is highly accurately formed in a Si substrate 11 having a thickness of 0.05 to 0.625 mm by wet etching or dry etching. A plurality of electrothermal conversion elements (printing element) 13 sandwiching the ink supply opening 12 and generating ejecting energy for ejecting ink and electrical wiring (not shown) of Al or the like communicating with the electrothermal conversion elements 13 are formed on a surface of the Si substrate 11 by a film forming technology. Further, the electrodes 14 are formed at both ends of the printing element substrate 10 in a longitudinal direction and are connected electrically to the electrical wiring member 30 for supplying power to the electrothermal conversion elements 13.

An ejecting opening forming member 15 made of a resin material is formed on the Si substrate 11, and a plurality of ejecting openings 16 corresponding to the electrothermal conversion elements 13 and an ink storage chamber 17 communicating with the ejecting openings 16 are formed in the ejecting opening forming member 15 by a photo lithography technology.

Figure 4:
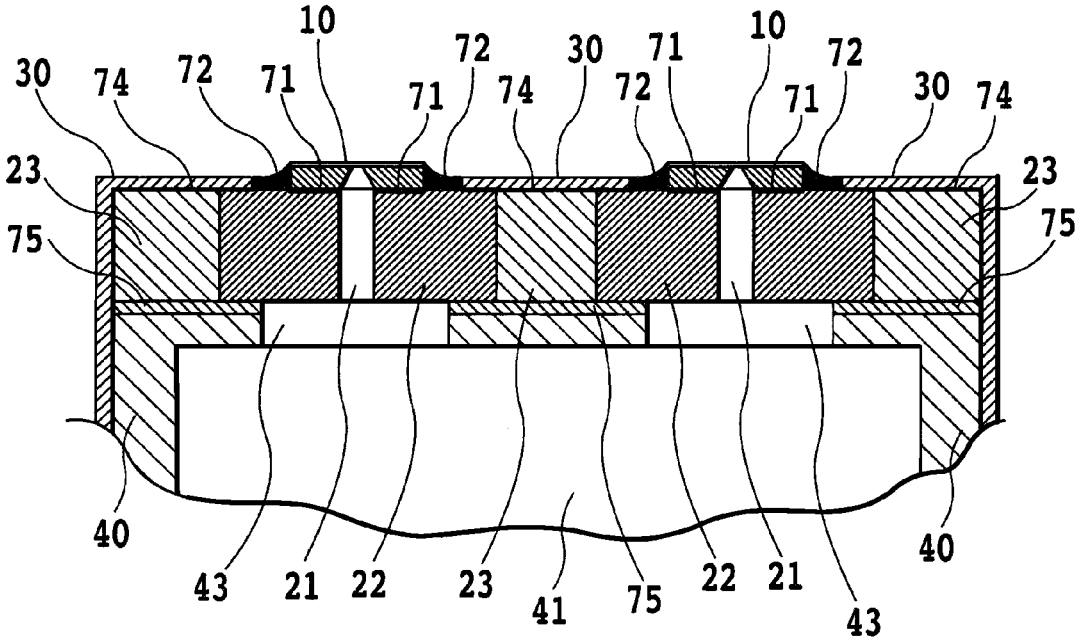
FIG. 4 is a cross section showing an outline in line IV-IV cross section in FIG. 1 in the first embodiment of the present invention.

FIG. 4 is a cross section showing an outline in line IV-IV cross section in FIG. 1.

Figure 5:
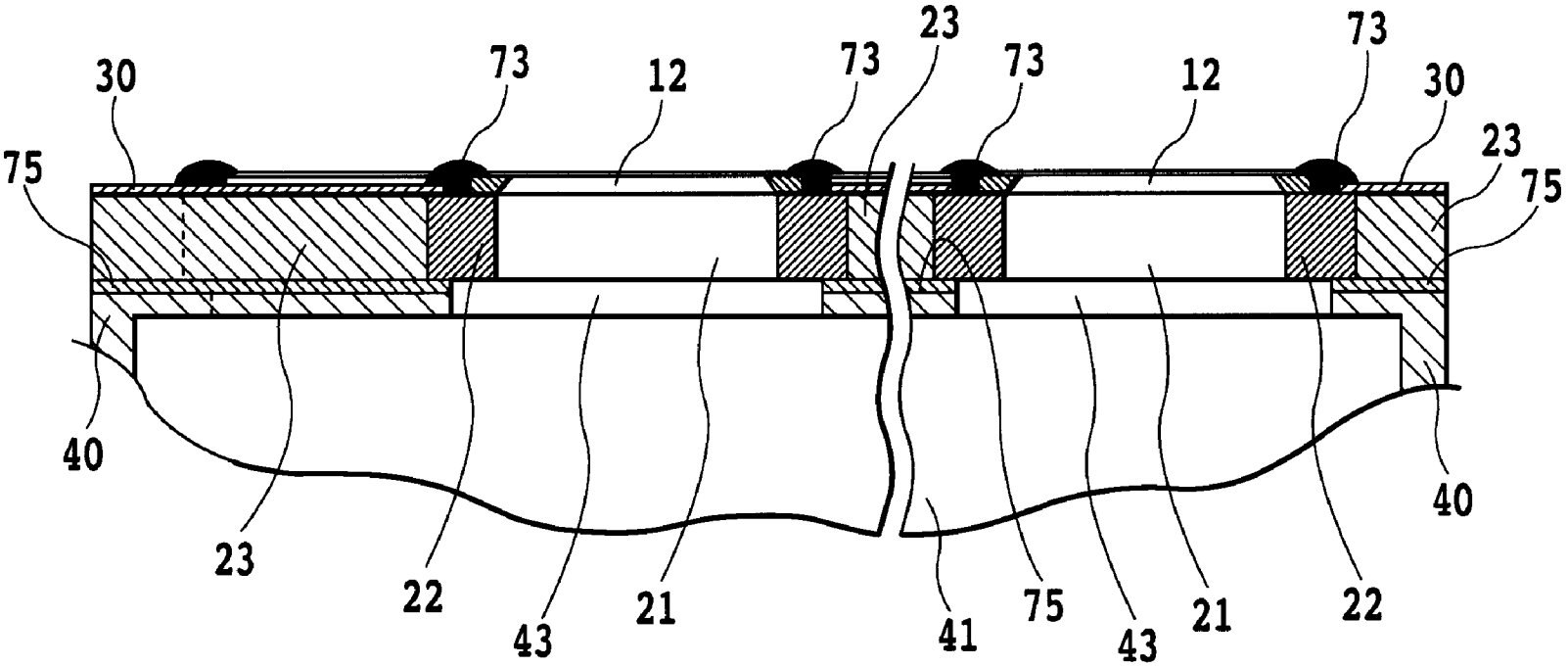
FIG. 5 is a cross section showing an outline in line V-V cross section in FIG. 1 in the first embodiment of the present invention.

FIG. 5 is a cross section showing an outline in line V-V cross section in FIG. 1.

The printing element substrate mounting member 22 is provided with an ink introduction opening 21 formed at a position corresponding to the ink supply opening 12 of the printing element substrate 10. The printing element substrate 10 is bonded to the printing element substrate mounting member 22 by a first adhesive 71.

The electrical wiring substrate 30 applies an electrical signal for ejecting the ink to the printing element substrate 10, and for example, uses a flexible wiring substrate of a two-layer structure of wires and has a surface layer covered with a polyimide film. The electrical wiring substrate 30 is bonded and fixed to a main surface of the support member 20 by a second adhesive 74. A clearance between the opening 31 and the printing element substrate 10 is sealed by a first sealant 72. Further, the electrode terminal 32 of the electrical wiring substrate 30 is connected electrically to the electrode 14 of the printing element substrate 10 by a wire bonding technology using a gold wire (not shown), and the electrical connection part is sealed by a second sealant 73.

In the support member 20, the small printing element substrate mounting members 22 made of alumina are molded integrally with the frame member 23 made of resin by insert molding. At the time of the insert molding, the printing element substrate mounting members 22 are accurately arranged and fixed to an injection die for molding the support member 20 by using positioning pins or the like, and are integrally molded with the frame resin by insert molding. Therefore, the printing element substrate mounting members 22 are accurately arranged and formed in the frame member 23 substantially with the arrangement precision (for example, relative position precision of the order of ±50 μm) inside the injection die. The support member 20 is, for securing a flatness degree of a surface of each of the printing element substrate mounting member 22 and the frame member 23, integrally molded, and thereafter, polished or the like. Accordingly, even if the printing head has a large printing width, it is possible to form the ink introduction opening 21 in the support member 20 at an accurate position, and the position shift between the ink supply opening 12 of the printing element substrate 10 and the ink introduction opening 21 of the support member 20 can be reduced to be very small.

In this arrangement, the printing element substrate 10 is bonded only to the printing element substrate mounting member 22 formed of alumina having a high rigidity and a small linear expansion coefficient. Therefore, it is possible to restrict the printing element substrate 10 to be shifted in position from the printing element substrate mounting member 22 after being bonded thereto and the printing element substrate 10 to be deformed or damaged subject to a temperature change.

The printing element substrate 10 in the present embodiment is bonded so that an outer periphery of the printing element substrate mounting member 22 and the frame member 23 forming the support member 20 are not exposed by locating a plate member in the ink storage chamber 41 of the ink supply member 40. That is, as shown in FIGS. 2 and 4, the ink supply member 40 has the plate member, which is a face bonding to the support member 20, to be formed integrally with the side face of the ink supply member 40. In consequence, in the frame member 23 and in the boundary part between the printing element substrate mounting member 22 and the frame member 23, which is the outer periphery of the printing element substrate mounting member 22, ink is not in contact therewith. In this arrangement, the resin material of the frame member 23 does not require properties of ink resistance.

That is, since in the support member 20, the printing element substrates 10 are required to be arranged with high precision of several μm, a high dimension stability is required in the resin material of the frame member 23 not only in the process at room temperatures, but also in a heating process of several hundred degrees during the mounting of the printing element substrate 10. In addition, a high molding performance is required since it is required to accurately insert-mold and fix the printing element substrate mounting member 22 made of alumina. Therefore, a particular base resin is used as the resin material of the frame member 23, and various types of additives are used. On the other hand, these particular resins or the various types of additives may generally adversely affect the ink. However, in the printing element substrate 10 in the arrangement of the present embodiment, since the frame member 23 is not in contact with the ink, selection of a usable material can be broadened.

The printing element substrate mounting members 22 of alumina are insert-molded in the frame member 23 of the resin material, but the respective members are closely fitted with each other. A coefficient of linear expansion of the printing element substrate mounting member 22 is different from that of the frame member 23, which is larger than the coefficient of linear expansion of the printing element substrate mounting member 22. Therefore, a temperature change or the like possibly causes a clearance between bonding faces of the members 22 and 23, thus deteriorating the ink sealing performance. In the printing element substrate 10 of the present embodiment, however, the bonding faces of the printing element substrate mounting member 22 and the frame member 23 are designed to be covered with a third adhesive or the ink supply member 40. Therefore, the ink sealing performance between the bonding faces is not required.

As described above, the support member 20 in the present embodiment is bonded to the ink supply member 40 in such a manner that the frame member 23 (second member), and the bonding faces of the printing element substrate mounting member 22 (first member) and the frame member 23 are not in contact with the ink storage chamber 41 in the ink supply member 40. Since the frame member 23 and the ink are not contacted with each other by such an arrangement, selection of the usable material can be broadened. Therefore, there can be inexpensively and simply provided a printing head with high reliability including a printing element substrate which is located with high positioning precision and therefore causes no occurrence of ink leak regardless of the printing head having a large printing width.

It should be noted that the bonding face of the ink supply member 40 with the support member 20 is formed of the plate-shaped member, but the present invention is not limited to such a member and the bonding face may be formed of, for example, a film-shaped member instead of the plate-shaped member.

(Modification of First Embodiment)

Figure 6:
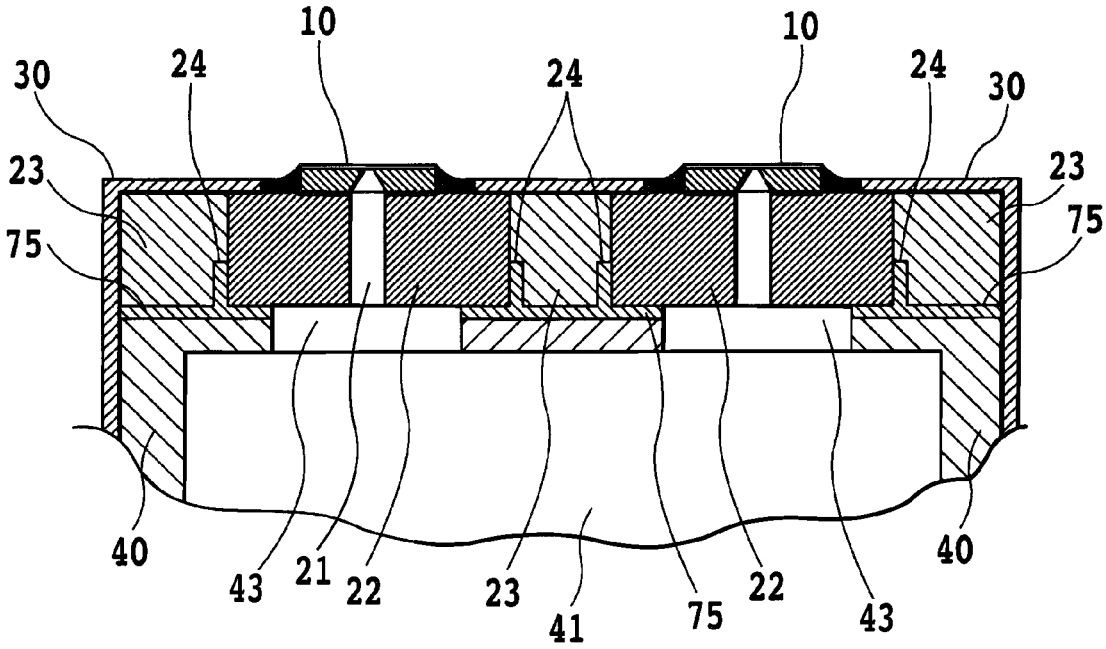
FIG. 6 is a cross section showing an outline in line IV-IV cross section in FIG. 1 in a modification according to the first embodiment of the present invention.

FIG. 6 is a cross section showing an outline in line IV-IV cross section in FIG. 1 according to a modification of the first embodiment. As shown in FIG. 6, in the present modification, a groove 24 is formed between the printing element substrate mounting member 22 and the frame member 23. Formation of the groove 24 causes the third adhesive 75 to enter into the groove 24. Therefore, by further covering the bonding faces of the printing element substrate mounting member 22 and the frame member 23 with the third adhesive, reliability of the printing element substrate 10 in the present invention can be further enhanced.

(Second Embodiment)

The printing element substrate 10 in the present invention may be provided with a support member 50 between the support member 20 and the ink supply member 40.

Figure 7:
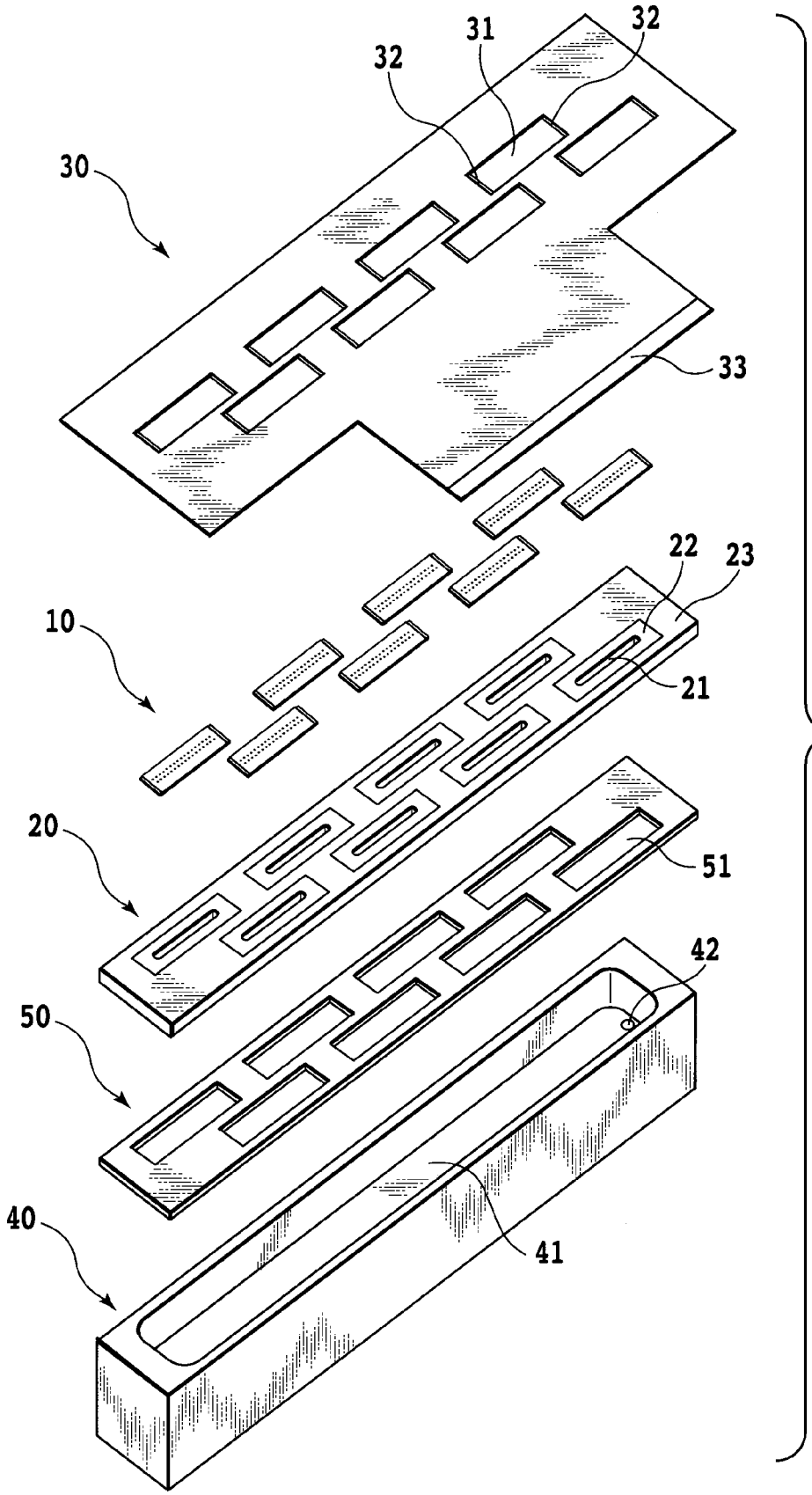
FIG. 7 is an exploded perspective view showing a printing head according to a second embodiment of the present invention.
Figure 8:
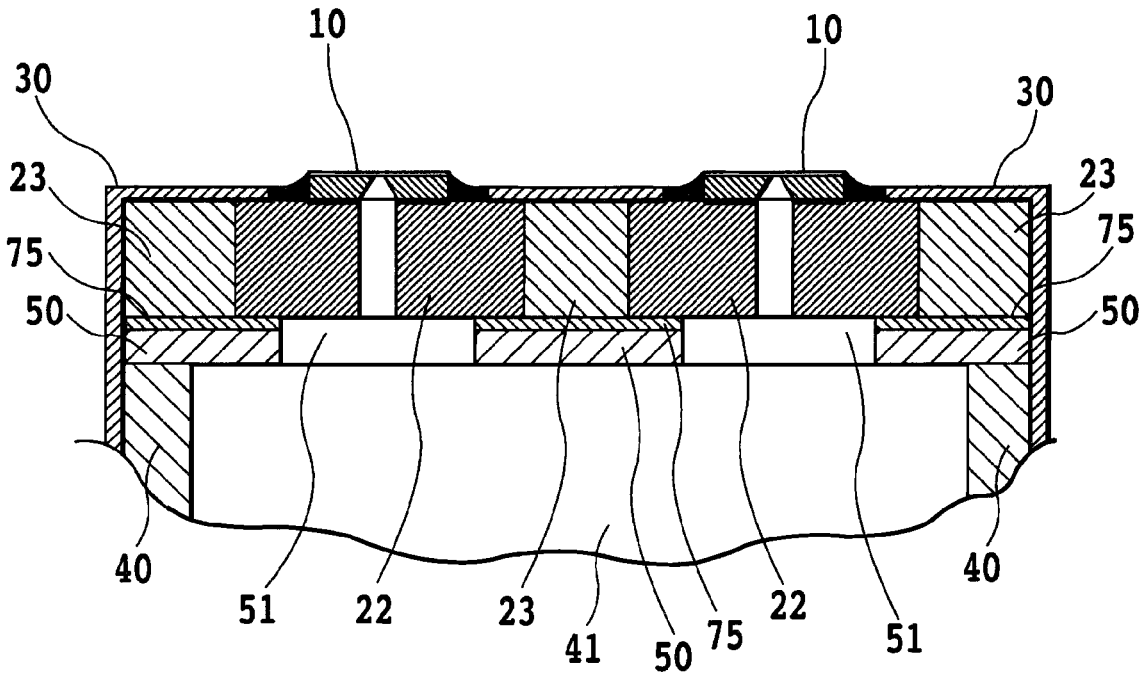
FIG. 8 is a cross section showing an outline in line IV-IV cross section in FIG. 1 in the second embodiment of the present invention.

FIG. 7 is an exploded perspective view showing the printing head in the present embodiment. FIG. 8 is a cross section showing an outline in line IV-IV cross section in FIG. 1.

In the present embodiment, the support member 50 is arranged between the support member 20 formed by the frame member 23 and the printing element substrate mounting member 22, and the ink supply member 40. As shown in FIG. 8, the support member 50 is provided with openings 51 formed at positions corresponding to the printing element substrate mounting members 22 of the support member 20, the opening 51 being sized to be smaller than an outer dimension of the printing element substrate mounting member 22. The support member 50 is arranged between the support member 20 and the ink supply member 40, and is bonded to the support member 20 by an adhesive 75 and is bonded to the ink supply member 40 by an adhesive or the other bonding means (not shown).

It should be noted that the support member 50 may be in advance bonded to the support member 20, thereafter bonded to the ink supply member 40 or may be bonded to the ink supply member 40, thereafter bonded to the support member 20, or further all the bonding processes may be performed simultaneously.

The support member 50 may be made of any material as long as it has properties of ink resistance. However, use of a material having transparency in the support member 50 allows use of an adhesive of photo curing performance or laser bonding, making it possible to in advance bond the support member 50 to the support member 20 or the ink supply member 40.

Further, since the support member 50 has a simple plate shape, a flatness of the bonding face can be easily secured. Therefore, the bonding reliability of the support member 50 to the support member 20 or the ink supply member 40 can be enhanced.

(Other Embodiment)

In the aforementioned embodiment, the single printing element substrate 10 is arranged in the single printing element substrate mounting member 22, but the present invention is not limited to this number.

Figure 9A:
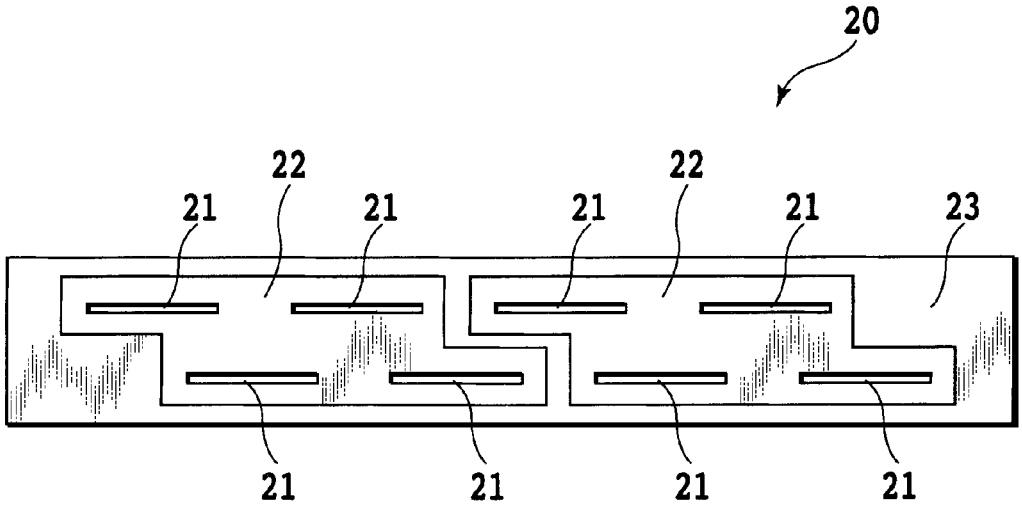
FIGS. 9A and 9B are diagrams each showing a support member in another embodiment of the present invention.
Figure 9B:
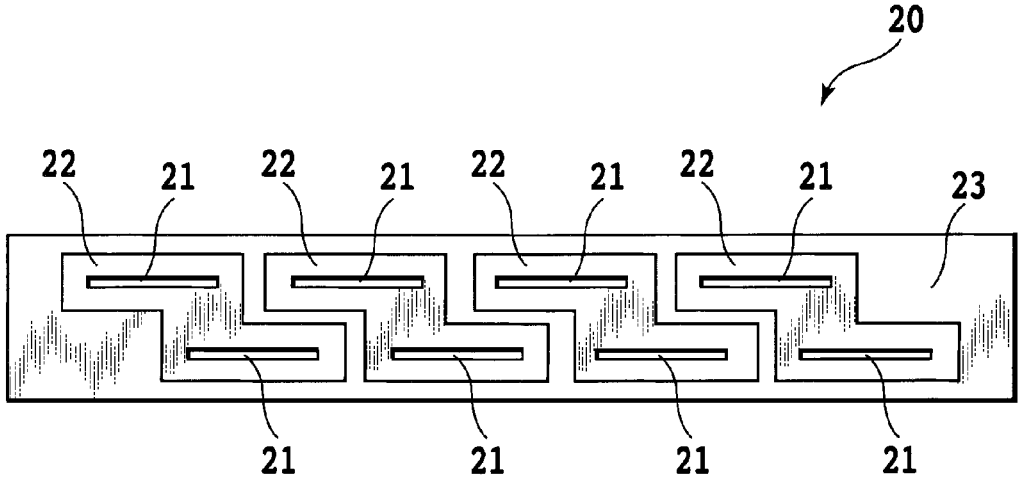
Figure 10:
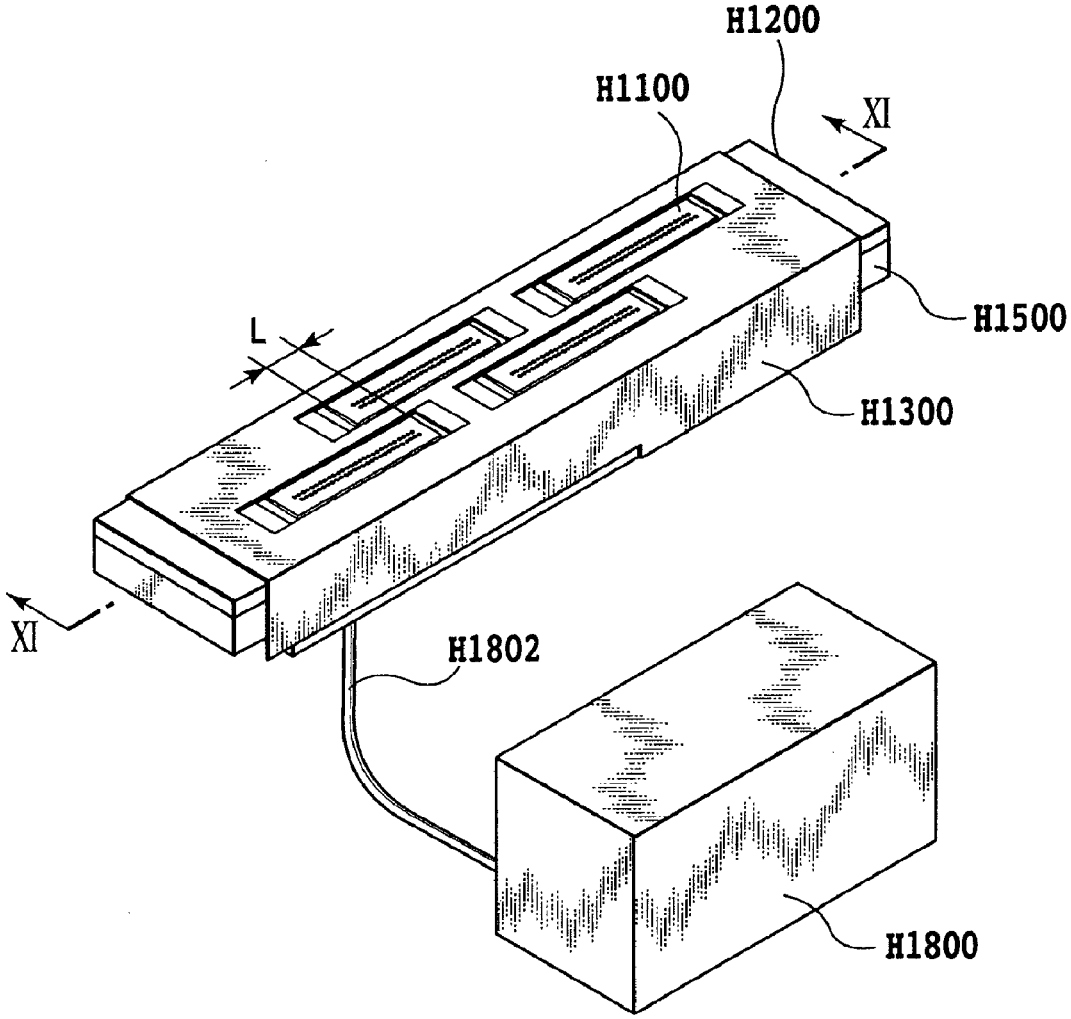
FIG. 10 PRIOR ART
FIG. 10 is a perspective view showing the conventional printing head.
Figure 11:
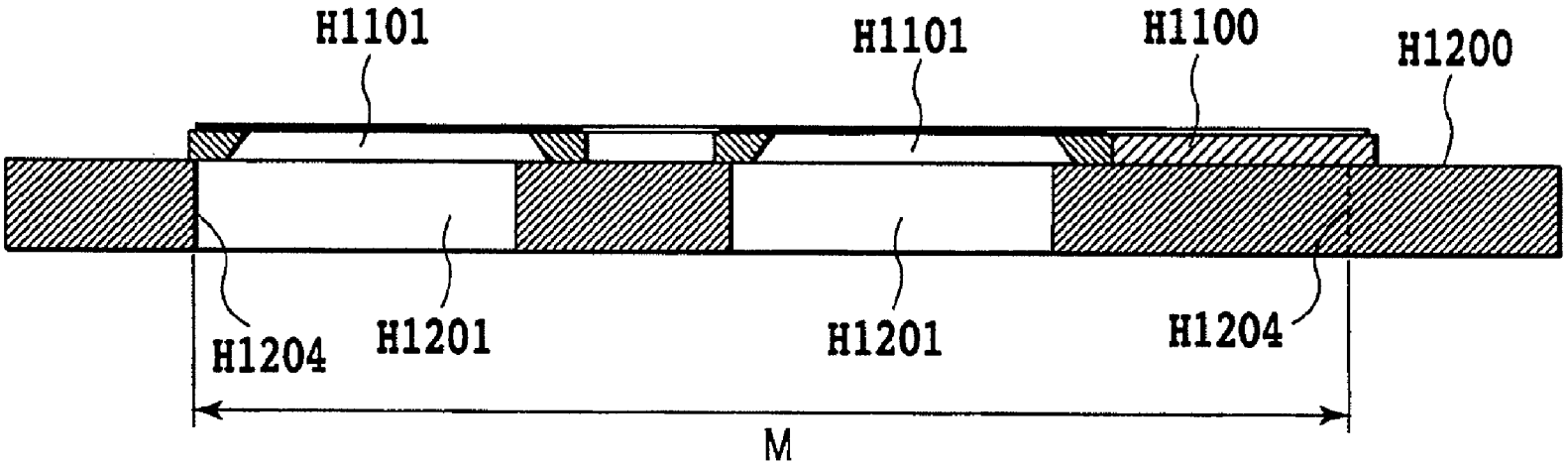
FIG. 11 PRIOR ART
FIG. 11 is a diagram explaining a state where an ink supply opening is shifted in position from an ink introduction opening.

FIGS. 9A and 9B are diagrams each showing a support member 20 in another embodiment of the present invention. The support member 20 in FIG. 9A is configured so that four printing element substrates 10 are arranged in a single printing element substrate mounting member 22. The support member 20 in FIG. 9B is configured so that two printing element substrates 10 are arranged in a single printing element substrate mounting member 22. That is, in the present invention, the number of the printing element substrates arranged in the single printing element substrate mounting member is not limited as long as the position shift of the ink introduction opening 21 is within an allowable dimension range.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-187110, filed Jul. 18, 2008, which is hereby incorporated by reference herein in its entirety.

What is claimed is:

1. An ink jet printing head comprising:

a plurality of printing element substrates, in each of which a plurality of ejecting openings for ejecting ink, printing elements for generating ejecting energy for ejecting the ink, and an ink supply opening for supplying the ink to the ejecting openings are formed;

a support member which supports the printing element substrates and includes a plurality of ink introduction openings for supplying the ink to the ink supply openings; and an ink supply member which is bonded to the support member and includes an ink storage chamber for storing the ink and an opening for supplying the ink stored in the ink storage chamber to at least one of the ink introduction openings, wherein the support member is formed of a first member in which at least one of the ink introduction openings is formed and a second member which is made of a material different from that of the first member and having a coefficient of linear expansion that is greater than a coefficient of linear expansion of the first member and is integral with the first member so as to surround the first member, and the support member and the ink supply member are bonded in such a manner that bonding faces of the first member and the second member, and the second member are not in contact with the opening.

2. An ink jet printing head according to claim 1, further comprising:

a plate-shaped member arranged between the support member and the ink supply member.

3. An ink jet printing head according to claim 1, further comprising:

a film-shaped member arranged between the support member and the ink supply member.

4. An ink jet printing head according to claim 1, wherein the first member is formed of alumina.

5. An ink jet printing head according to claim 1, wherein the second member is formed of resin.

6. An ink jet printing head according to claim 1, wherein the first member and the second member are made integral with each other by insert molding.

* * * * *